United States Patent [19]

Goodrich

[11] 4,006,441

[45] Feb. 1, 1977

[54] PEDAL-OPERATED VOLUME CONTROL

[76] Inventor: Philip C. Goodrich, 12571 Lincoln St., Grand Haven, Mich. 49417

[22] Filed: Dec. 24, 1975

[21] Appl. No.: 644,181

[52] U.S. Cl. ..... 338/153; 74/512; 74/560; 84/1.27

[51] Int. Cl.[2] ..... H01C 10/00

[58] Field of Search ..... 338/47, 69, 153, 108, 338/215; 200/86.5; 74/478, 512, 515, 560, 561; 84/1.17, 1.27, DIG. 7, DIG. 25, 229

[56] References Cited

UNITED STATES PATENTS

| | | | |
|---|---|---|---|
| 2,139,217 | 12/1938 | Aiala | 338/153 X |
| 2,681,586 | 6/1954 | Pressler | 338/153 X |
| 2,986,953 | 6/1961 | DeArmond et al. | 338/153 X |

*Primary Examiner*—C. L. Albritton
*Attorney, Agent, or Firm*—Glenn B. Morse

[57] ABSTRACT

A rotary potentiometer is actuated by a pedal movement converted to rotary motion by a cable-sheave arrangement in which the sheave has a varying radius to its peripheral surface. The sheave is preferably mounted on the potentiometer shaft in an angular relationship that causes a minimum rotation of the shaft for a given pedal movement at a minimum resistance condition of the potentiometer.

4 Claims, 5 Drawing Figures

Fig. 1
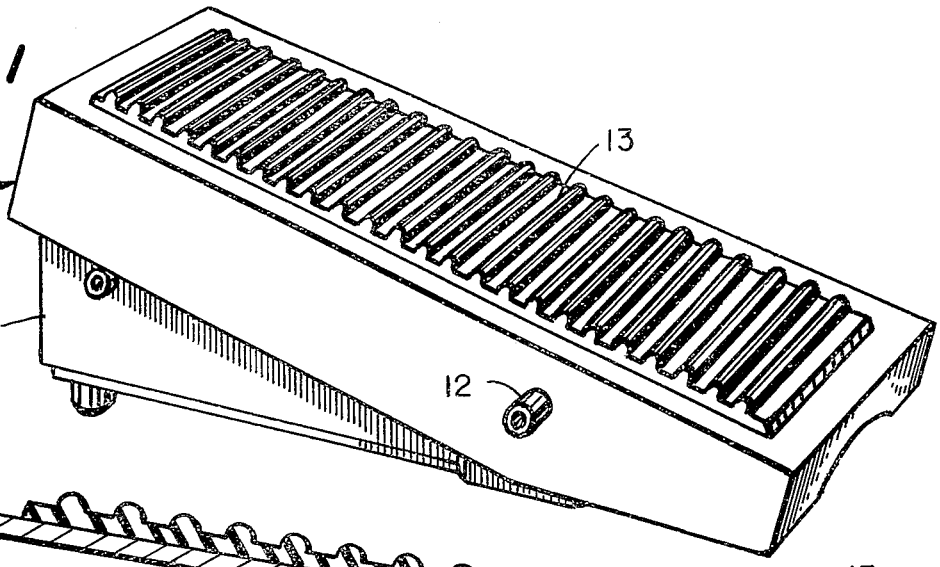
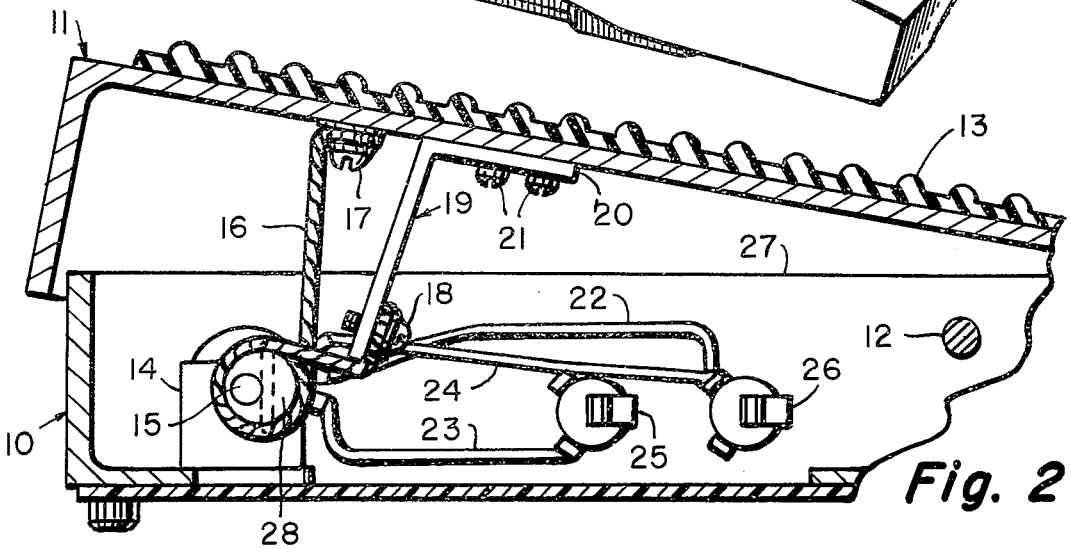
Fig. 2
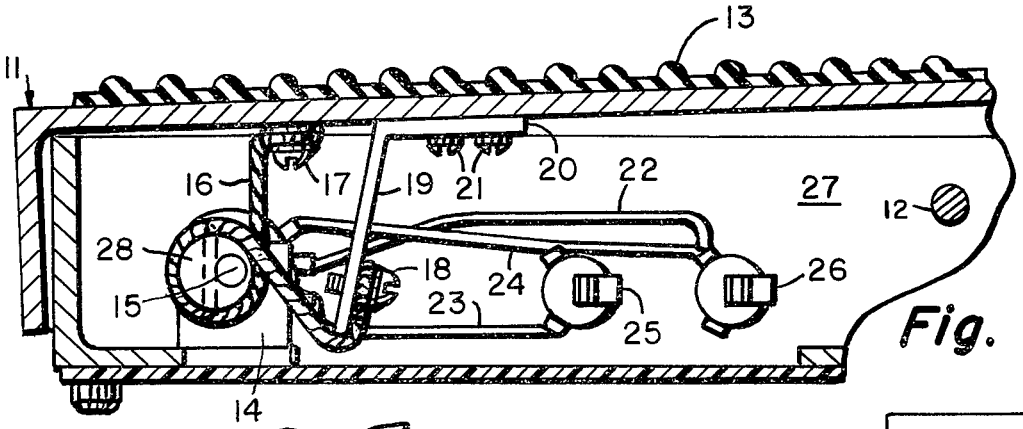
Fig. 3
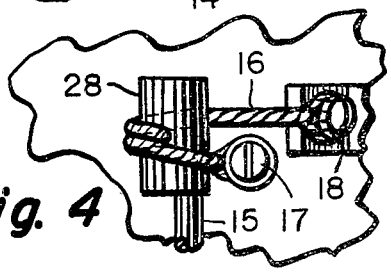
Fig. 4
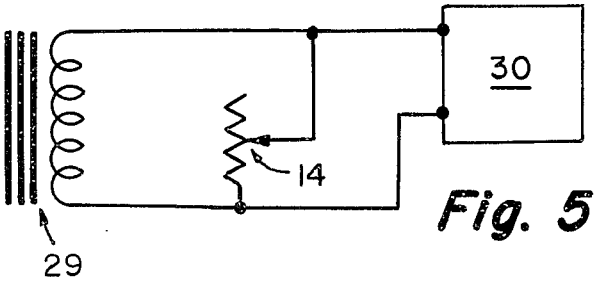
Fig. 5

PEDAL-OPERATED VOLUME CONTROL

BACKGROUND OF THE INVENTION

The individual amplification of the sound of musical instruments is now common practice. It appears to be most convenient to control the volume of the amplifying system with a pedal device. This arrangement gives the musician continuing control over the dynamics of his instrument, and frees his hands for their usual functions. One of the usual volume control arrangements for any kind of an electrical circuit is the potentiometer, which is a variable resistance. These units are commonly incorporated in a pedal control, together with a mechanism for converting the angular movement of the pedal into a rotary motion of a potentiometer shaft. The conversion mechanism can be selected from the standard available systems, such as an arcuate rack secured to the pedal and engaging a pinion on the potentiometer shaft, or the ancient bow drill principle, in which a cord is wrapped around a shaft and secured at its ends to two points that move together. When these two points are terminals secured to the moving pedal, it is obvious that pedal movement will induce rotation of the potentiometer shaft. The present invention presents an improvement in this type of device. A problem commonly associated with these controllers occurs particularly when the controller is connected in shunt relationship with the signal pickup on the musical instrument. The controller is thus obviously in shunt relationship also with the amplifier. The volume control is effected by varying the resistance of this shunt, resulting in a maximum volume when the potentiometer is at a maximum resistance. The problem occurs at the other extreme, in which minimum volume in associated with a minimum resistance. The usual potentiometer, even though it may be of a type having a logarithmic resistance gradient, tends to be over-sensitive and erratic at conditions approaching minimum resistance. This is a serious problem to the musician, as this is precisely where he needs the most delicate dynamic control over his instrument.

SUMMARY OF THE INVENTION

A sheave is provided with a mounting hole for receiving the shaft of a potentiometer installed in a pedal controller. The sheave has a configuration such that the radius to the peripheral surface varies from a maximum to a minimum. A cable extending between terminals on the moveable pedal is passed around this sheave, and the angular relationships of the system are such that the sheave surface at the point of maximum radius to the axis of the potentiometer shaft is tangent to the cable at a condition of minimum resistance of the potentiometer. This condition also corresponds to the "up," or un-actuated, position of the pedal. As the pedal is depressed at a given rate, the cable induces a rotation of the shaft which progressively increases in rate until the cable is tangent at the point of minimum radius to the potentiometer shaft.

DESCRIPTION OF THE DRAWINGS

FIG. 1 is a perspective view of the exterior of a standard pedal controller.

FIG. 2 is a section along a central plane of the controller shown in FIG. 1, in the un-actuated (minimum resistance) condition.

FIG. 3 is a view similar to FIG. 2, with the pedal depressed to produce a potentiometer condition corresponding to maximum resistance.

FIG. 4 is a fragmentary view illustrating the cable terminals shown in FIGS. 2 and 3.

FIG. 5 is a schematic view showing the incorporation of the controlling device in the usual amplifying system associated with a musical instrument.

DESCRIPTION OF THE PREFERRED EMBODIMENTS

The controller illustrated in the drawings has a base frame 10 and a moveable pedal 11 pivoted to the base on the bolt 12, which functions as a fulcrum. The pedal 11 will normally have a surfacing material of corrugated rubber as indicated at 13. In the interior of the device, the potentiometer 14 is mounted on the frame, with the shaft 15 substantially horizontal. A cable 16 extends from the terminal screw 17 to the second terminal screw 18 mounted in the end of the arm 19. This arm is L-shaped, with the base 20 secured to the pedal 11 by the screws 21. The leads 22, 23, and 24 extend to the plug receptacles 25 and 26 mounted in the side wall 27 of the box-shaped frame 10.

The cable 16 is wrapped around the sheave 28 mounted on the potentiometer shaft 15. This sheave preferably has a cylindrical surface that is eccentric to the hole receiving the shaft 15, and the installation on the shaft is such that the position of the tangency of the cable 16 with respect to the sheave is at a maximum radius to the axis of the shaft 15 when the potentiometer is at a minimum resistance condition. This is illustrated in FIG. 2. As the pedal 11 is depressed to the FIG. 3 condition, the movement of the cable induced by the movement of the cable terminals induces a rotation of the shaft 15 to a position in which the cable is tangent at a minimum radius to the axis of the potentiometer shaft 15, and thus induces a maximum rate of rotation of the shaft for a given amount of movement of the pedal 11.

FIG. 5 illustrates the usual arrangement for incorporating the controller in an amplifier system. The potentiometer 14 is connected in shunt relationship with the pickup device 29, and thus also in shunt relationship with the amplifier 30. Under conditions of minimum resistance of the potentiometer 14, the shunt effect is maximum. This corresponds to a minimum signal input into the amplifier 30, and thus a minimum output volume. Under these conditions, the arrangement illustrated in FIGS. 2 and 3 provide the musician with a much greater degree of control over the dynamics of his instrument. The sensitivity problem previously referred to is thus eliminated.

I claim:

1. A controller for an electrical circuit, said controller including a frame, an actuator moveably mounted on said frame, rotary potentiometer means having a control shaft and secured to said frame, and cable means operably associating said actuator and said potentiometer whereby movement of said actuator induces rotation of said potentiometer shaft, wherein the improvement comprises:

sheave means secured to said control shaft, said sheave means having a hole receiving said control shaft, and having a peripheral cable-receiving surface disposed at a varying radius from the axis of said hole providing a gradient to the rate of rotation of said shaft with respect to the movement of said actuator.

2. A controller as defined in claim 1, wherein said actuator is a pedal pivotally mounted on said frame, and said cable-receiving surface is cylindrical and eccentric with respect to said hole.

3. A controller as defined in claim 1, wherein said cable means is tangent to said cable-receiving surface at a position adjacent the maximum radius thereof when said potentiometer means is set for a minimum electrical resistance.

4. A controller as defined in claim 3, wherein said cable means is tangent to said cable-receiving surface at a position adjacent to the minimum radius thereof when said potentiometer means is set for maximum electrical resistance.

* * * * *